US006279267B1

(12) United States Patent
Barrett et al.

(10) Patent No.: US 6,279,267 B1
(45) Date of Patent: Aug. 28, 2001

(54) VEHICLE DOOR ASSEMBLY

(75) Inventors: Eric William Barrett, Milford; Robert Edward Kosior, Livonia; Rajinder Pal Singh, Plymouth, all of MI (US)

(73) Assignee: Ford Global Tech., Inc., Dearborn, MI (US)

( * ) Notice: Subject to any disclaimer, the term of this patent is extended or adjusted under 35 U.S.C. 154(b) by 0 days.

(21) Appl. No.: 09/372,082

(22) Filed: Aug. 11, 1999

(51) Int. Cl.[7] ..... E05D 15/10
(52) U.S. Cl. ..... 49/224; 49/221
(58) Field of Search ..... 49/224, 221, 225, 49/234, 235, 322, 360, 407, 436, 437

(56) References Cited

U.S. PATENT DOCUMENTS

| | | | | |
|---|---|---|---|---|
| 1,712,562 | | 5/1929 | Jeffers . | |
| 3,708,192 | | 1/1973 | Klebba et al. . | |
| 4,152,872 | * | 5/1979 | Tanizaki et al. | 49/223 X |
| 4,502,246 | | 3/1985 | Minami . | |
| 4,559,740 | * | 12/1985 | Tuchiya et al. | 49/223 X |
| 4,606,146 | * | 8/1986 | Jozefozak | 49/228 X |
| 5,361,540 | | 11/1994 | Rogers, Jr. et al. . | |
| 5,934,022 | * | 8/1999 | Faubert | 49/360 |
| 6,036,257 | * | 3/2000 | Manuel | 49/213 X |

* cited by examiner

*Primary Examiner*—Jerry Redman
(74) *Attorney, Agent, or Firm*—Ford Global tech, Inc

(57) ABSTRACT

An assembly for use with a vehicle sliding door 12 which includes a first wheel 24, which is movably disposed within a first track 40 located on the vehicle and having a ramped portion 44, and a second wheel 32 which is movably disposed within a second track 60. The assembly includes a brake pad 62, which is disposed within the second track 60, which frictionally engages the second wheel 32, and which cooperates with the ramped portion 44 to hold door 12 in an open position.

7 Claims, 1 Drawing Sheet

VEHICLE DOOR ASSEMBLY

FIELD OF THE INVENTION

This invention relates to a vehicle door assembly and more particularly, to an assembly which may be used in combination with a slidable vehicle door and which allows the door to maintain an open position.

BACKGROUND OF THE INVENTION

Doors allow individuals to selectively enter and exit a vehicle and cooperatively provide a selectively closed passenger compartment which protects the vehicle occupants as the vehicle is driven. One type of door which has become relatively popular, especially when deployed upon a "van type" vehicle, is a sliding door. Particularly, the sliding door is usually relatively large and selectively and movably extends across the entire passenger compartment as well as the storage compartment which resides behind the driver's seat. This relatively large sliding door therefore, when selectively moved to an open position, allows the entire passenger compartment and storage area to be accessed, thereby allowing for relatively easy entry into the entire passenger compartment and storage area and allowing groceries and other packages and containers to be easily placed within the vehicle. Moreover, some vehicles have multiple sliding doors, thereby allowing access into the vehicle from a number of directions or "sides". While these sliding doors allow for relatively easy entry into the van or vehicle, they suffer from some drawbacks.

Perhaps one of the greatest drawbacks which is associated with these deployed sliding doors is that the doors, while capable of being selectively opened, do not adequately "lock" or remain open, especially if the vehicle is parked or is resident upon a hill or other inclined road. Thus, each of the relatively large and open doors often and unexpectedly close, thereby annoying those individuals or pets who are resident within the doors' path of closure.

While attempts have been made to selectively and securely "lock" the doors in the open position, these attempts have various drawbacks and are not particularly desirable. That is, these prior attempts include relatively costly and complicated latching mechanisms which are prone to failure and/or malfunction and which increase the amount of force which is required to close the opened door. This last drawback is particularly troublesome to children, the elderly, and other individuals of slight stature.

There is therefore a need for a vehicle door assembly which may be used in combination with a sliding vehicle door, which is relatively low in cost, which has relatively "uncomplicated" and relatively "simple" components, and which substantially ensures that the selectively opened sliding door is held in the open position without substantially increasing the amount of force needed to close the opened door.

SUMMARY OF THE INVENTION

It is a first object of the invention to provide a vehicle door assembly which overcomes at least some of the previously delineated drawbacks associated with vehicle door assemblies and with prior attempts at causing the vehicle door to maintain an open position.

It is a second object of the invention to provide a vehicle door assembly which is relatively low in cost, which is relatively simple in design, which allows a sliding vehicle door to be movable between a first open position and a second closed position, and which further allows the vehicle door to maintain the first open position until moved to the second closed position.

It is a third object of the invention to provide a relatively low-cost vehicle door assembly which causes a vehicle door to remain in an open position, which allows the selectively opened door to be selectively closed, and which does not substantially increase the amount of force required to close the open door.

According to a first aspect of the present invention, an assembly for use with a sliding door of the type used within a vehicle is provided. Particularly, the sliding door is movable from a first closed position to a second open position and includes a first wheel which is movably disposed upon a ramped track which is formed within the vehicle and a second wheel which is movably disposed within a second track which is formed within the vehicle. The assembly includes a brake pad which is selectively positioned within the second track and which engages the second wheel as the door is moved to the second open position and which cooperates with the ramped track and the first wheel to allow the door to remain in the second open position.

According to a second aspect of the invention, a method is provided to allow a vehicle door to remain in a selectively open position. The method includes the steps of causing the opened vehicle door to frictionally engage a portion of the vehicle when the vehicle door is selectively placed in the open position, thereby substantially ensuring that the open vehicle door remains in the open position.

These and other features, advantages, aspects, and embodiments will become apparent from a reading of the following specification and by reference to the following drawings.

DETAILED DESCRIPTION OF THE PREFERRED EMBODIMENT OF THE INVENTION

Figure 1:
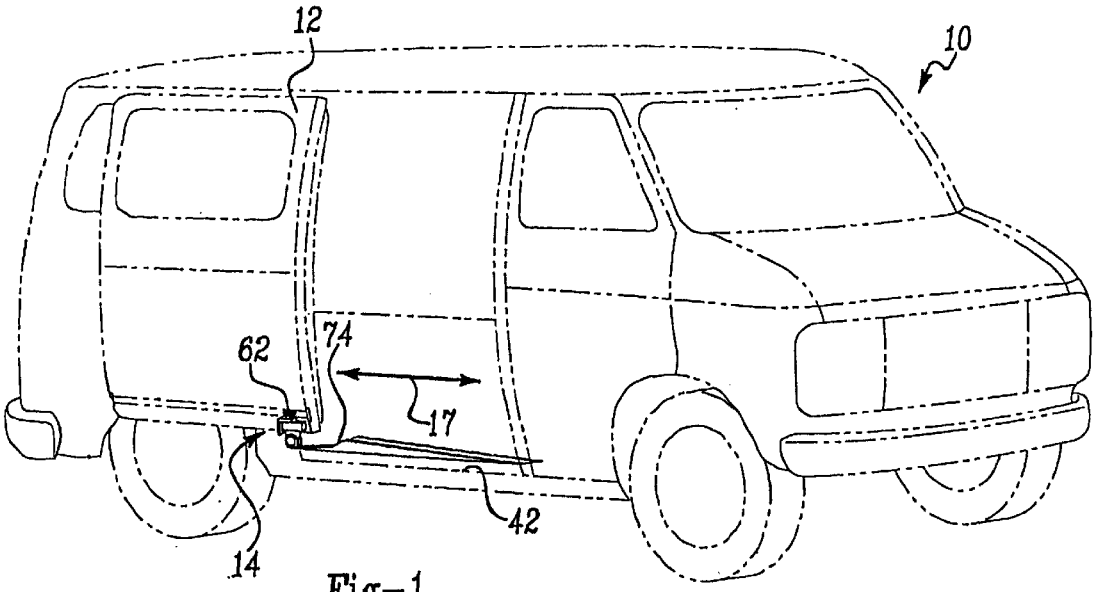
FIG. 1 is a perspective view of a vehicle having a door assembly which is made in accordance with the teachings of the preferred embodiment of the invention.
Figure 2:
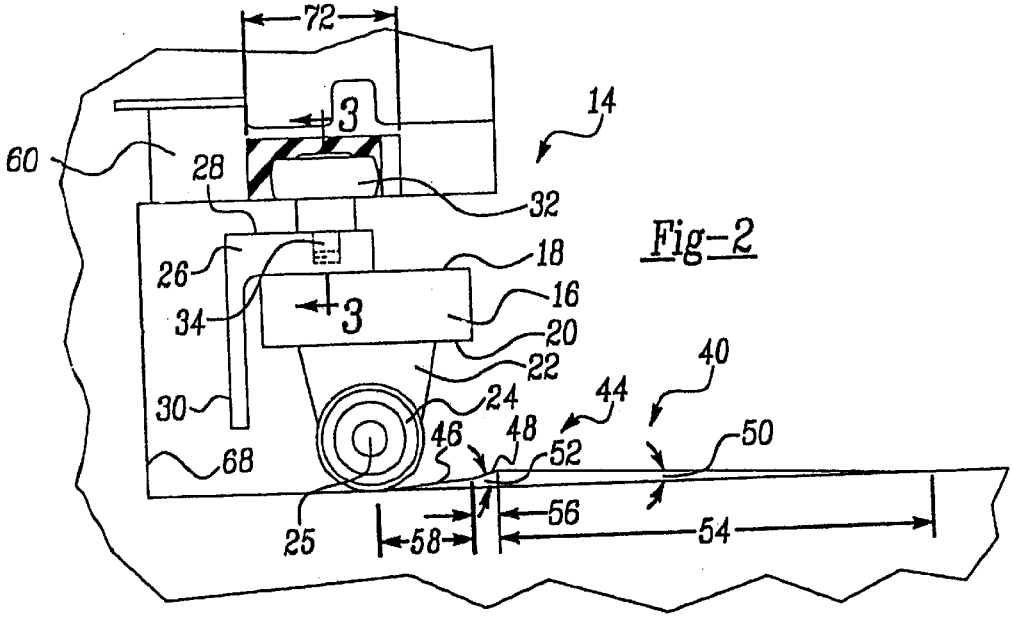
FIG. 2 is a fragmented exploded side view of the vehicle which is shown in FIG. 1 and more particularly, showing the deployed door assembly which is made in accordance with the teachings of the preferred embodiment of the invention and which is shown in FIG. 1.
Figure 3:
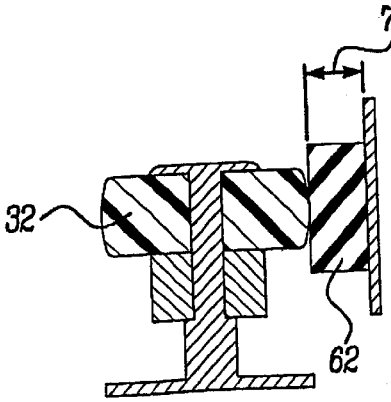
FIG. 3 is a view of the portion of the vehicle which is shown in FIG. 2 and which is taken along view line 3—3.

Referring now to FIGS. 1–3 there is shown a "van type" vehicle 10 having a sliding door 12 and a door assembly 14 which is made in accordance with the teachings of the preferred embodiment of the invention. As shown, door assembly 14 is selectively attached and/or is coupled to and/or movably resides within the door 12, and the door 12 is selectively movable between a closed and an open position and between an open and a closed position. These selective directions of travel of the door 12 are shown by bi-directional arrow 17.

Particularly, door assembly 14 comprises a body 16 having a generally rectangular cross sectional area and generally flat, substantially identical, and respective top and bottom surfaces 18, 20. Body 16 further includes an integrally formed first wheel mounting member or portion 22 which taperingly and downwardly extends and protrudes from the bottom surface 20 of body 16, while being selectively and movably coupled to a wheel 24 by use of a conventional pin 25. Wheel 24 therefore selectively rotates about pin 25 (e.g., about the longitudinal axis of the pin 25).

Body 16 further includes an integrally formed and generally "L"-shaped wheel mounting member 26 having a first portion 28 which, in one non-limiting embodiment, is integrally formed with member 16 and, more particularly, which overlays and extends from top surface 18, and a second portion 30 which is integrally formed with and which orthogonally projects from portion 28, parallel to the direction along which member 22 extends. Further, a conventional wheel 32 is movably deployed within member 16 by the use of a conventional threaded type screw 34 which is insertably positioned into the top surface 18 of member 14 and into the wheel 32. Hence, wheel 32 selectively rotates about the longitudinal axis of the threaded screw 34. In one non-limiting embodiment, wheel 24 and 32 are substantially identical.

Assembly 10, in one non-limiting embodiment, further includes a ramped track 40 which is deployed upon and is substantially linearly coextensive to the edge of the vehicle floor 42 over which the door 12 resided when the door 12 is placed in a selectively closed position. Track 40 includes a ramp 44 having first and second contiguous elevated portions 46, 48. In one non-limiting embodiment of the invention, angle 50 is about 2.3 degrees while angle 52 is about 5 degrees. Further, length 54 is about 101 millimeters, length 56 is about six millimeters, and length 58 is about 22.91 millimeters.

Assembly 10 further includes a second track or channel 60 which is formed in and is substantially coextensive to the track 40, which movably receives wheel 32, and which has opposed closed ends. As further shown, brake pad or frictional member 62 is selectively attached to the vehicle within the channel 60 at a position which causes the moving wheel 32 to engage the brake pad 62 when the door 12 is placed into a substantially and complete open position. Channel 60 may be selectively covered in an alternate embodiment of the invention.

Further, in one non-limiting embodiment, brake pad 62 is formed from conventional and commercially available rubber and is generally rectangular in shape. Brake pad 62 may be operatively deployed within the channel 60 by the use of a conventional adhesive material. Alternatively, brake pad 62 may be integrally formed within vehicle 10 and/or within the door 12. In this non-limiting embodiment, the width 70 of brake pad 62 is about ten millimeters and the length 72 of brake pad 62 is about twenty millimeters. Other shapes, sizes and geometric configurations may be utilized. Moreover, conventional grease or other lubricating substances may be used upon pad 62 to reduce frictional wear of the pad 62.

Wheels 24 and 32 movably and respectively reside within tracks 40, 60 and cooperatively allow the door 12 to be selectively opened and closed. Particularly, as the door 12 is moved to the open position, wheel 24 is forced to traverse the ramp 44, first engaging portion 48 and then 46, before residing in the position which is best shown in FIG. 2. Concomitantly, while wheel 32 moves within track 60 until the wheel 32 frictionally engages the brake pad 62. Particularly, brake pad 62 is not engaged by wheel 32 until after wheel 24 traverses the ramp 44, as shown best in FIG. 2. In the open position, portion 74 of the ramp 44 functions as a wheel curb hindering movement of wheel 24 which would tend to close door 12, and cooperates with the brake pad 62 to hold the door 12 in the open position (shown best in FIG. 1) until the vehicle user forces the door 12 to the closed position. The use of dissimilar elevated portions 46, 48 substantially prevents the door 12 from inadvertently and undesirably closing, while allowing the door 12 to be rather easily and intentionally closed. It should be appreciated that while one type or configuration of ramp 44 is shown, other configurations may be utilized. Moreover, it should be appreciated that a substantially identical assembly 10 may be utilized on other types of sliding doors and that a pair of such assemblies may be used in vehicles having two sliding doors.

When the door 12 is closed, member 30 engages the end wall 68 of the door and protects body 16 and wheels 24 and 32 from damage due to a "slamming" of the door by absorbing door closing forces and substantially preventing these forces from being communicated to the other part of the assembly 14. It should also be appreciated that pad 62 may be independently utilized separate and apart from the ramps 44 and hence, brake pad 62 may be selectively used in vehicles having wheels 32, 24 which are disposed in ramped and/or non-ramped channels.

It should be understood that the invention is not limited to the exact construction and method illustrated and described above, but that various changes and modifications may be made without departing from the spirit and the scope of the following claims. It should further be apparent that assembly 10 represents a relatively cost-effective and uncomplicated solution to the foregoing undesirably vehicle door closing difficulty.

What is claimed is:

1. An assembly for use in combination with a vehicle sliding door which is coupled to at least one wheel disposed within a track and which is movable between a closed and an open position by use of said at least one wheel, said assembly comprising a rubber brake pad which is disposed within said track and which is frictionally engaged by said at least one wheel when said vehicle sliding door is moved to said open position, effective to hold said vehicle door in said open position.

2. The assembly of claim 1 wherein said brake pad is substantially rectangular.

3. The assembly of claim 2 wherein a lubricating substance is applied to said brake pad.

4. An assembly for use in combination with a door of a vehicle, said assembly comprising:

a first member which is movably disposed within a track within said vehicle;

a second member which is coupled to said first member, which is selectively and movably disposed within said vehicle, and which cooperates with said first member to allow said door to be selectively moved from a first closed position to a second open position;

a rubber brake pad which is selectively disposed within said track and which frictionally engages said first member when said door is moved to said open position, thereby holding said door in said open position; and a ramped track which is disposed within said vehicle and which selectively and movably receives said second member, said ramped track having a ramp which cooperates with said rubber brake pad to hold said door in said second open position.

5. The door assembly of claim 4 wherein said brake pad is rectangular.

6. An assembly for use in combination with a door of a vehicle, said assembly comprising:

a first member which is movably disposed within a track within said vehicle;

a second member which is coupled to said first member, which is selectively and movably disposed within said vehicle, and which cooperates with said first member to allow said door to be selectively moved from a first closed position to a second open position;

a third member which is selectively disposed within said track and which frictionally engages said first member wherein said door is moved to said open position, thereby holding said door in said open position; and a ramped track which is disposed within said vehicle and which selectively and movably receives said second member, said ramped track having a ramp which includes a first and a second inclined portion wherein said second portion is inclined by a greater amount than said first inclined portion, and which cooperates with said third member to hold said door in said second open position.

7. The door assembly of claim 6 wherein said first and said second inclined portions are contiguous.

* * * * *